US008083401B2

(12) United States Patent
Nakano et al.

(10) Patent No.: US 8,083,401 B2
(45) Date of Patent: Dec. 27, 2011

(54) CONNECTOR HOLDER UNIT, CARRIAGE, RECORDING APPARATUS, AND LIQUID EJECTING APPARATUS

(75) Inventors: Yosuke Nakano, Suwa (JP); Takashi Sato, Shibata-gun (JP); Keiichiro Fukumasu, Kitakyushu (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 12/892,491

(22) Filed: Sep. 28, 2010

(65) Prior Publication Data

US 2011/0012962 A1 Jan. 20, 2011

Related U.S. Application Data

(63) Continuation of application No. 11/767,110, filed on Jun. 22, 2007, now Pat. No. 7,891,771.

(30) Foreign Application Priority Data

Jun. 22, 2006 (JP) ..... 2006-173002
Jun. 22, 2006 (JP) ..... 2006-173003

(51) Int. Cl.
*B41J 2/14* (2006.01)

(52) U.S. Cl. ..... 374/50

(58) Field of Classification Search ..... 347/50
See application file for complete search history.

(56) References Cited

U.S. PATENT DOCUMENTS 5,627,577 A * 5/1997 Buican ..... 347/50
5,757,403 A * 5/1998 Nagashima ..... 347/50
6,151,046 A * 11/2000 Abe et al. ..... 347/50
6,168,262 B1 * 1/2001 Clark et al. ..... 347/50
6,280,017 B1 8/2001 Miyauchi
6,431,684 B1 * 8/2002 Olsen ..... 347/50
6,502,917 B1 1/2003 Shinada et al.
2008/0284830 A1 11/2008 Shinada et al.
2009/0009560 A1 1/2009 Shinada et al.
2009/0027453 A1 1/2009 Shinada et al.
2009/0040274 A1 2/2009 Shinada et al.
2009/0040275 A1 2/2009 Shinada et al.

FOREIGN PATENT DOCUMENTS

JP 01-139490 U 9/1989
JP 07-022487 U 4/1995
JP 09-161889 6/1997
JP 10-326651 12/1998
JP 2000-198190 A 7/2000
JP 2000-208184 7/2000
JP 2001-113722 A 4/2001
JP 2002-234191 8/2002
JP 2003-011389 A 1/2003
JP 3093148 U 4/2003
JP 2003-257522 9/2003
WO 99/59823 11/1999

* cited by examiner

*Primary Examiner* — Charlie Peng
(74) *Attorney, Agent, or Firm* — Workman Nydegger

(57) ABSTRACT

A connector holder unit that is formed separately from a carriage capable of housing an ink cartridge and can be attached to the inside of the carriage includes a connector holder, a connector having a plurality of contact arms that is installed to the connector holder, and a circuit substrate having a plurality of conductive connection portions that is installed to the connector holder, wherein contact terminals of the plurality of contact arms of the connector are configured to elastically contact the conductive connection portions of the circuit substrate and conductive connection portions of the ink cartridge so as to electrically conduct between the circuit substrate and the ink cartridge when the connector holder unit is attached to the carriage.

8 Claims, 11 Drawing Sheets

CONNECTOR HOLDER UNIT, CARRIAGE, RECORDING APPARATUS, AND LIQUID EJECTING APPARATUS

CROSS-REFERENCE TO A RELATED APPLICATION

This application is a continuation of U.S. patent application Ser. No. 11/767,110 filed Jun. 22, 2007 which claimed priority to Japanese Patent Application Number 2006-173002 filed Jun. 22, 2006 and Japanese Patent Application Number 2006-173003 filed Jun. 22, 2006. The entire disclosures of these applications are expressly incorporated herein by reference.

BACKGROUND

1. Technical Field

The present invention relates to a connector holder unit implementing electrical conduction between an ink cartridge that is housed in a carriage with a connector and a circuit substrate installed thereto and the circuit substrate for reading information on the ink cartridge housed in a carriage through the circuit substrate, a carriage having the connector holder unit, and a recording apparatus having the carriage.

In addition, the invention relates to a liquid ejecting apparatus such as an ink jet recording apparatus performing recording (ejecting liquid) on a recording medium (liquid ejecting medium) by ejecting (injecting) liquid such as ink from its head.

Here, the term "liquid ejecting apparatus" is used for referring not only to a recording apparatus, such as a printer, a copier, and a facsimile machine, having an ink jet recording head for ejecting ink from the recording head so as to perform recording on a recording medium but also to an apparatus that causes liquid to adhere onto a medium, corresponding to the recording medium in the above described recording apparatus, by ejecting liquid selected depending on the use of the apparatus in place of ink onto the medium from a liquid ejecting head corresponding to the above-described ink jet recording head.

Examples of the liquid ejecting head other than the recording head described above are a color-material ejecting head that is used for manufacturing a color filter for liquid crystal displays or the like, an electrode material (conduction paste) ejecting head that is used for forming an electrode in an organic electroluminescent (EL) display, a field emission display (FED), or the like, a bioorganic compound ejecting head that is used for manufacturing bio-chips, and a sample spraying head as a precision pipette.

2. Related Art

In JP-A-2003-257522, there is disclosed a connector which includes a position determining attachment portion that is engaged with a front end of a memory circuit substrate and a hook portion locking a rear end of the memory circuit substrate, wherein the memory circuit substrate is attached in a detachable manner, a plurality of contact portions of the connector having spring contact with terminals of the memory circuit substrate is configured, and a contact portion having a low load among the plurality of contact portions is disposed on the position determining attachment portion side.

However, in the technology disclosed in JP-A-2003-257522, since the circuit substrate is locked into the hook portion in a sliding method using elastic deformation of the circuit substrate, there is a case where a resist of the circuit substrate or the like is cut away. Thus, there is a possibility that foreign bodies such as cut resists are interposed between the contact portions to cause deterioration of signal transmission therebetween. In addition, since the connector holder is provided inside the carriage in advance and the circuit substrate and the connector are required to be installed to the connector holder thereafter, it is relatively difficult to install the circuit substrate and the connector.

SUMMARY

An advantage of some aspects of the invention is that it provides a connector holder unit in which a circuit substrate and a connector can be installed to a connector holder in an easy manner and which does not generate foreign bodies at a time when the circuit substrate and the connector are installed, a carriage having the connector holder unit, and a recording apparatus and a liquid ejecting apparatus that have the carriage.

According to a first aspect of the invention, there is provided a connector holder unit that is formed separately from a carriage capable of housing an ink cartridge and can be attached to the inside of the carriage. The connector holder unit is provided with a connector holder, a connector having a plurality of contact arms that are installed to the connector holder, and a circuit substrate having a plurality of conductive connection portions that is installed to the connector holder. Contact terminals of the plurality of contact arms of first and second connect arms of the connector are configured to elastically contact the conductive connection portions of the circuit substrate and conductive connection portions of the ink cartridge so as to electrically conduct between the circuit substrate and the ink cartridge when the connector holder unit is attached to the carriage.

In the first aspect, since the connector holder unit is formed separately from the carriage, it is not needed to install the connector and the circuit substrate to the connector holder by using a sliding method, and accordingly, a problem such as generation of foreign bodies due to cut of resists do not occur. In addition, an operation for installment of the connector and the circuit substrate 9 can be simplified, compared to a case where the connector and the circuit substrate are installed after attachment of the connector holder to the carriage.

According to a second aspect of the invention, in the connector holder unit according to the first aspect, the circuit substrate is installed to the connector holder to have a clearance that enables the circuit substrate to be able to move in the front or rear direction of the connector holder.

While the circuit substrate and the connector are mounted on the connector holder in advance for forming the connector holder unit before being attached to the carriage according to an aspect of the invention, there is a case where it takes a long time from storage as the connector holder unit to installment of the connector holder unit to the carriage. In such case, a force pressing the circuit substrate to its back side in accordance with the spring force of the contact is applied to the connector holder, and whereby the connector holder may be deformed to be bent as a counter action thereof. Thus, there is a case where the deformed connector holder unit cannot be attached to the carriage.

In the second aspect, since the circuit substrate is attached in a status that the circuit substrate is slightly movable in the front or of rear direction of the connector holder, a spring force of the contact of the connector reduces a biasing force applied to the connector holder through the circuit substrate, and whereby bending deformation of the connector holder can be prevented.

According to a third aspect of the invention, in the connector holder unit according to the first aspect, the circuit substrate has a configuration in which the circuit substrate is pivoted about one side between upper and lower sides of the circuit substrate in a status that the side of the circuit substrate is supported by a position determining portion of the connector and the other side is approached to the connector holder for being engaged with the connector holder.

In the third aspect, since there is used a configuration in which the circuit substrate is attached to the connector holder by a pivoting movement without being sled into the connector holder, a problem such as cut of the resists due to a mistake in the attachment of the circuit substrate does not occur. In addition, since elastic deformation of the circuit substrate during the attachment operation does not occur, deterioration of quality of the circuit substrate can be prevented.

According to a fourth aspect of the invention, there is provided a carriage that can house an ink cartridge. The carriage is provided with the connector holder unit according to the first aspect.

In the fourth aspect, a carriage that can prevent generation of foreign bodies such as small fragments cut away from the resists and assuredly transmit information on the ink cartridge to the circuit substrate side is provided.

According to a fifth aspect of the invention, there is provided a recording apparatus. The recording apparatus is provided with a transport unit transporting a recording medium, a recording unit performing recording on the recording medium that is transported by the transport unit, and a carriage that reciprocates in a main scanning direction which is perpendicular to a transport direction of the recording medium. The carriage is the carriage according to the fourth aspect.

BRIEF DESCRIPTION OF THE DRAWINGS

The invention will be described with reference to the accompanying drawings, wherein like numbers reference like elements.

DESCRIPTION OF EXEMPLARY EMBODIMENTS

Figure 1:
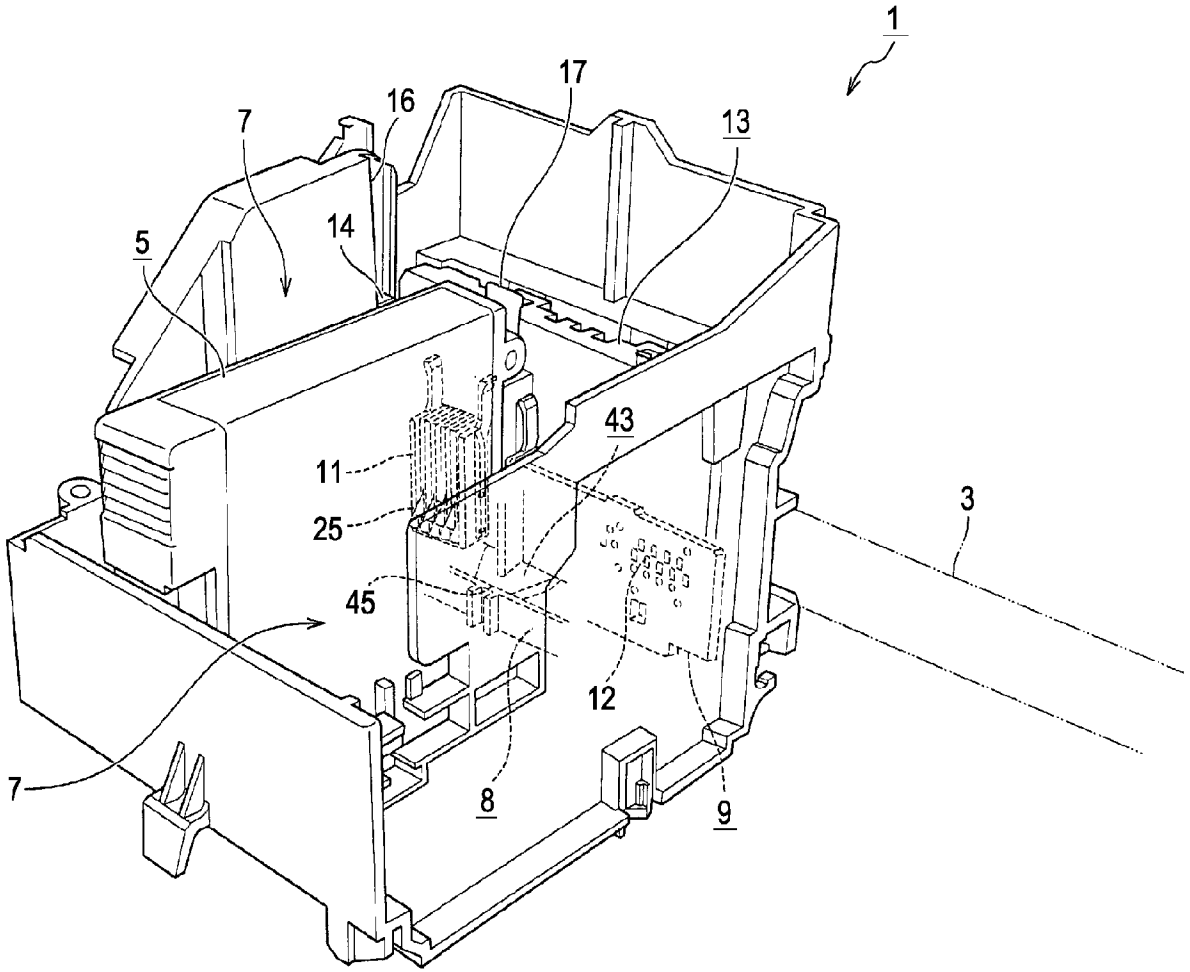
FIG. 1 is a perspective view of a carriage for an ink jet printer according to an embodiment of the invention.
Figure 2B:
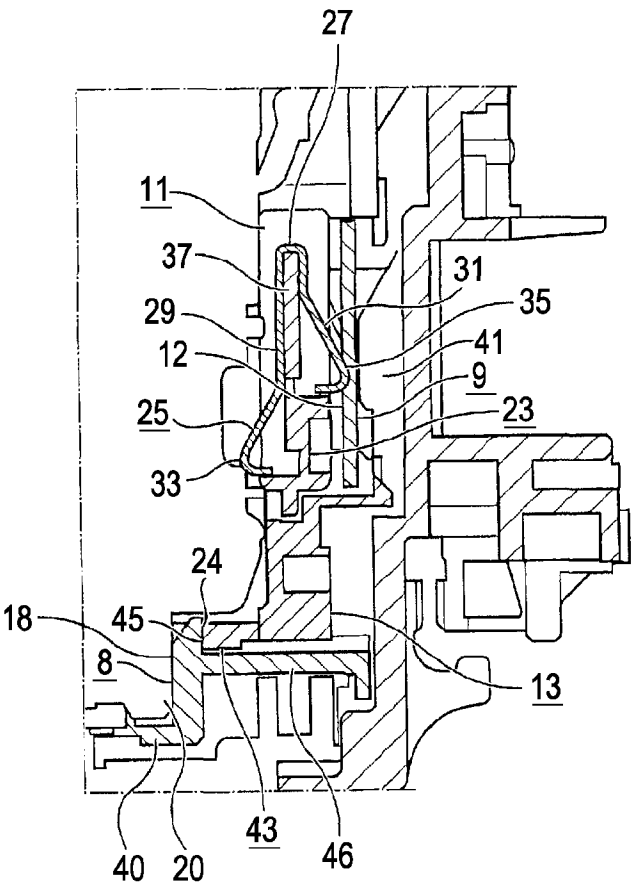
FIG. 2B is an enlarged side sectional view of the connector and a lower side thereof.
Figure 2A:
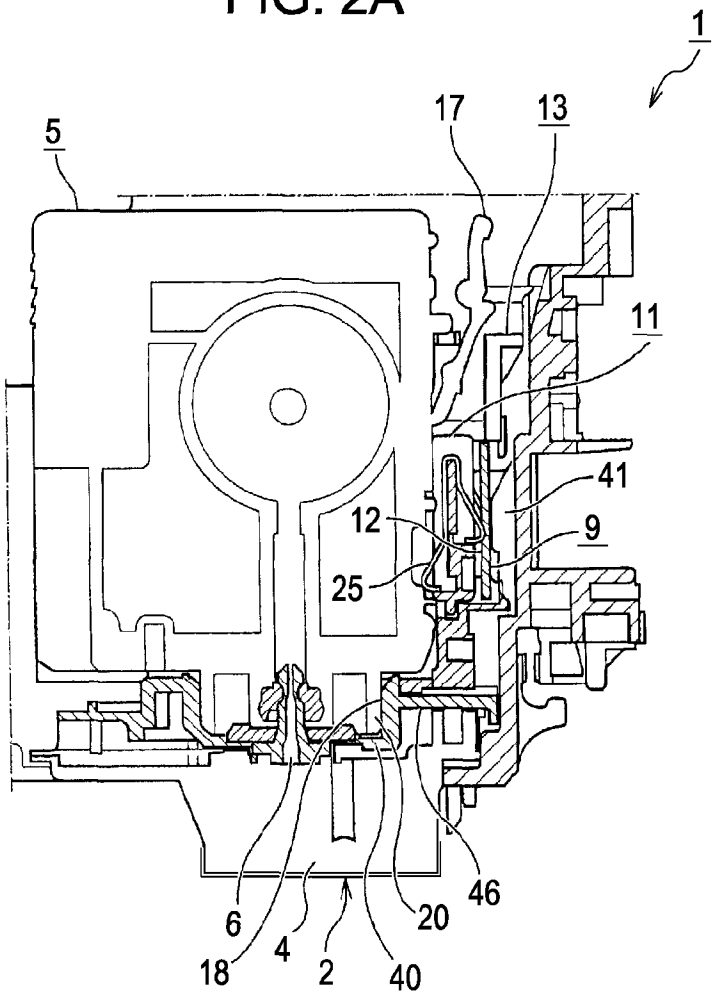
FIG. 2A is a side sectional view of a connector and the vicinity thereof according to an embodiment of the invention.
Figure 3:
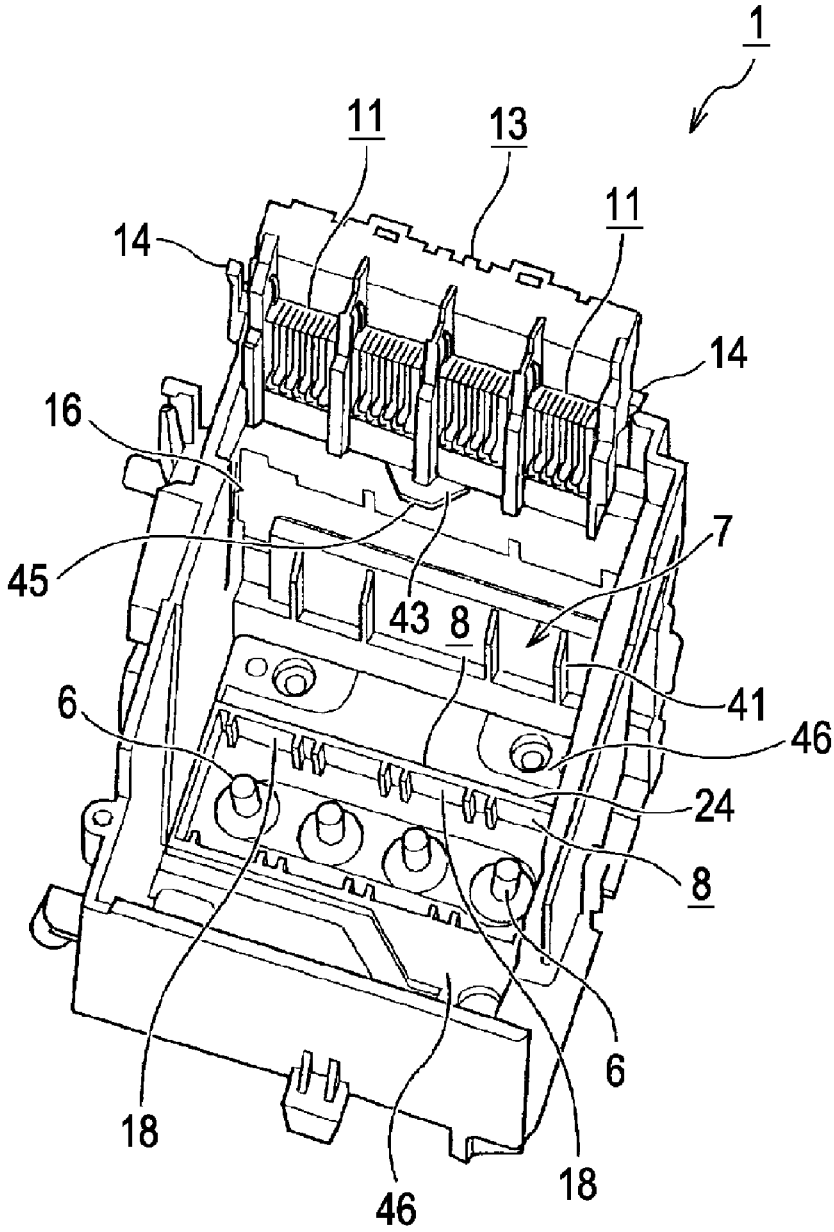
FIG. 3 is a perspective view of the inside of a carriage according to an embodiment of the invention at a time right before installment of a connector holder unit.
Figure 4:
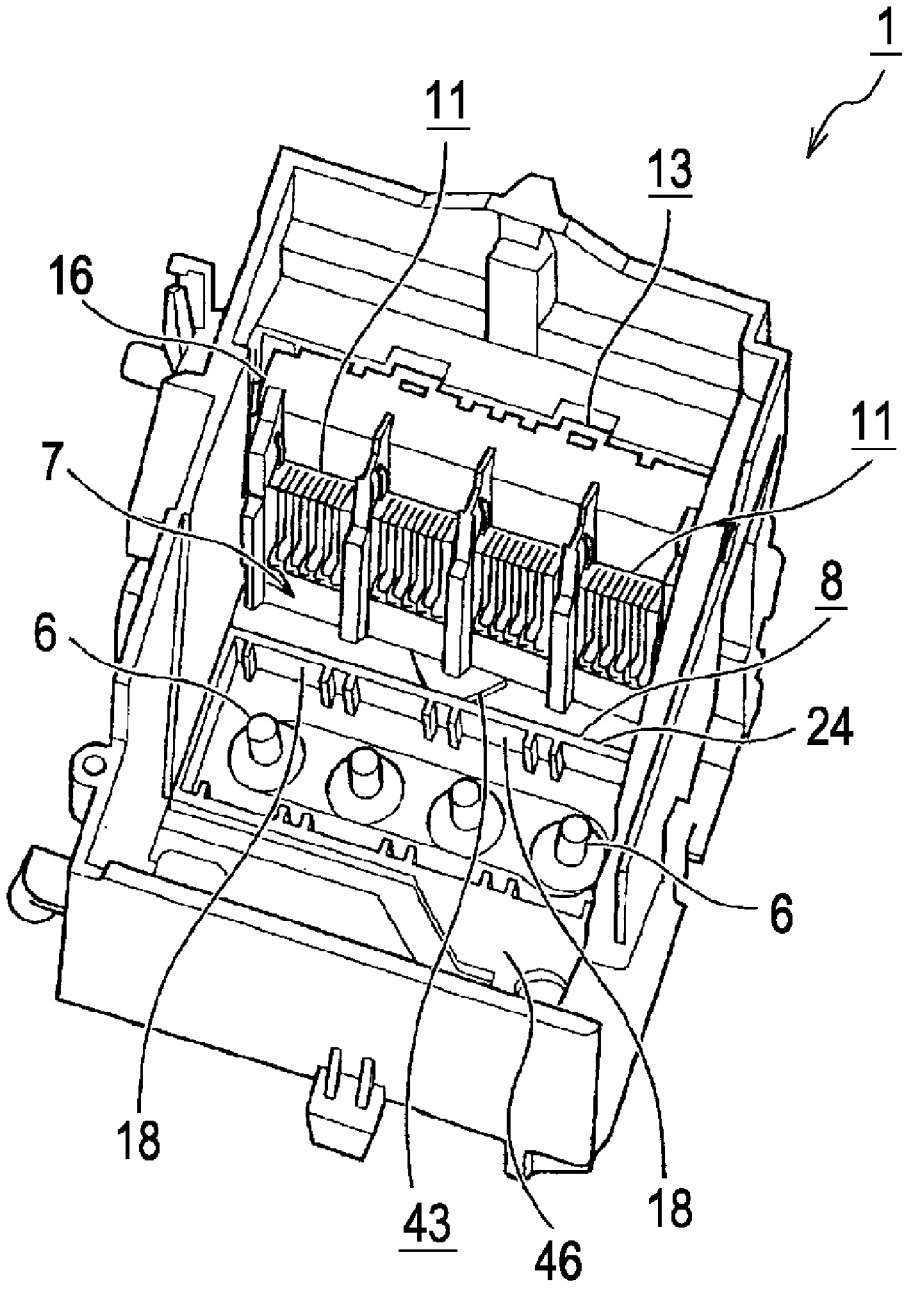
FIG. 4 is a perspective view of the inside of the carriage at a time when the connector holder unit is installed.
Figure 5:
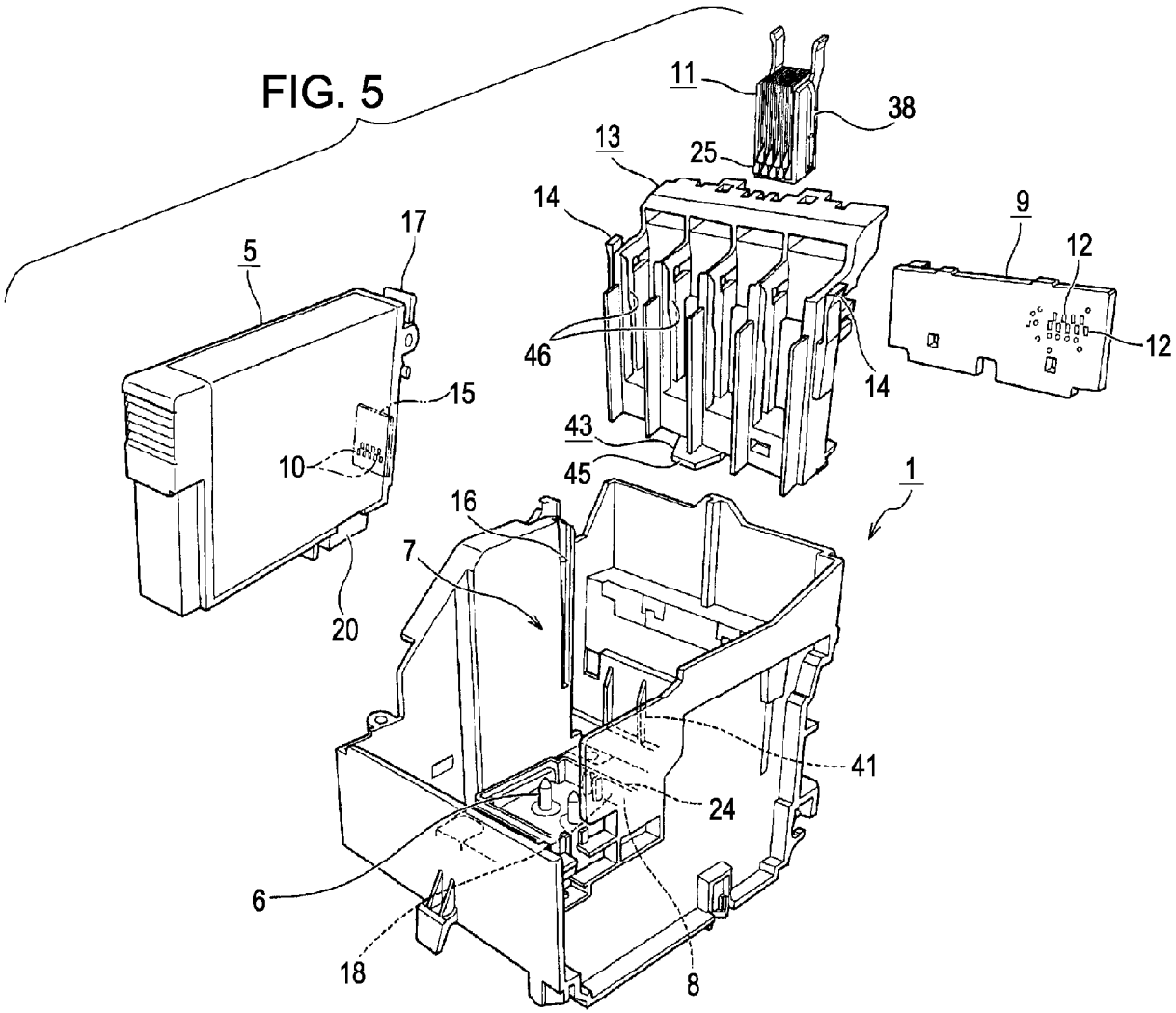
FIG. 5 is an exploded perspective view of constituent members adjacent to the connector holder according to an embodiment of the invention.
Figure 6:
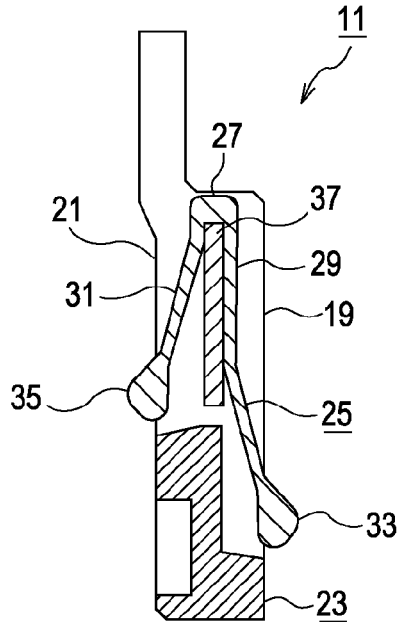
FIG. 6 is a longitudinal sectional view of a connector according to an embodiment of the invention.
Figure 7:
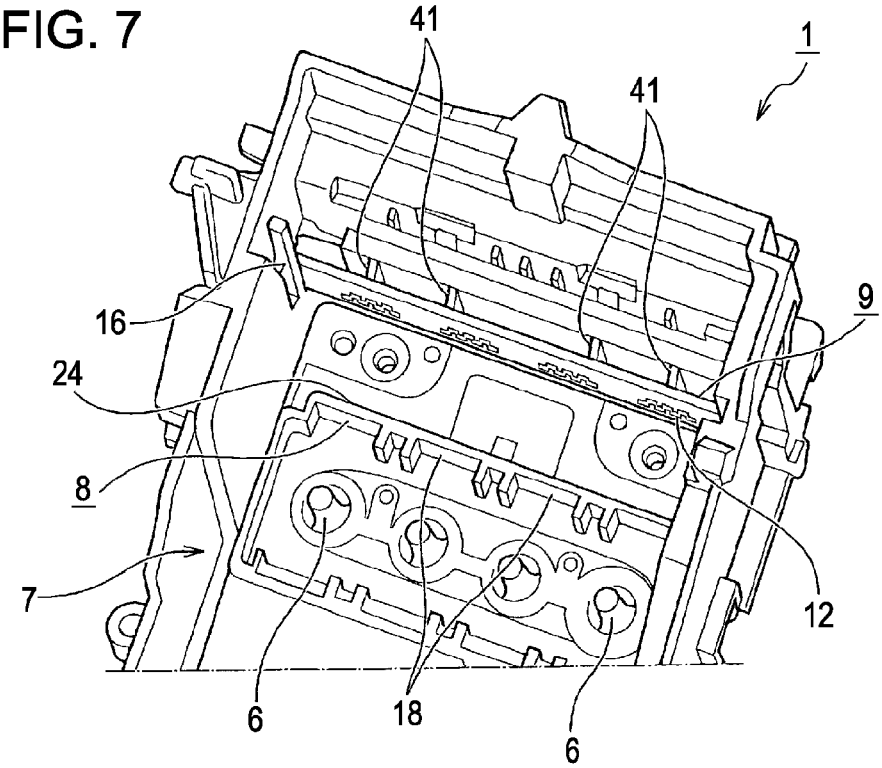
FIG. 7 is a perspective view of the inside of a carriage according to an embodiment of the invention, showing the vicinity of a circuit substrate.
Figure 8:
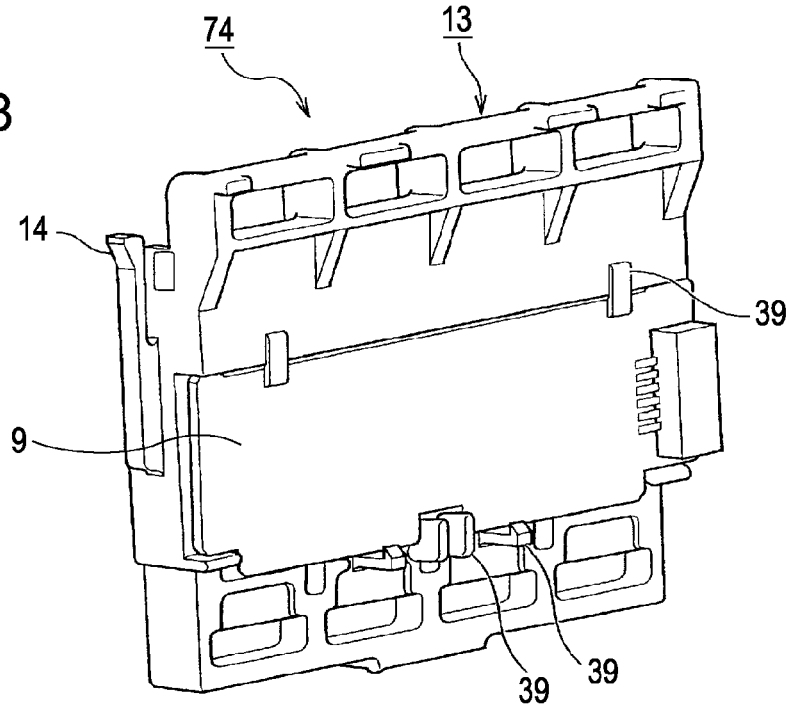
FIG. 8 is a perspective view of the back side of a connector holder unit according to an embodiment of the invention.
Figure 9:
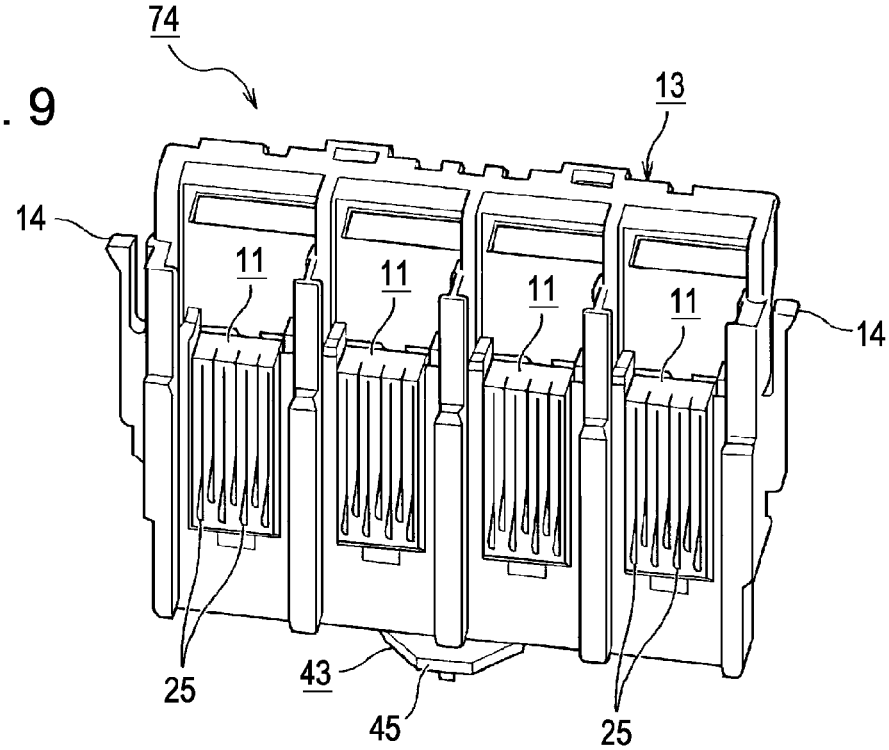
FIG. 9 is a perspective view of the front side of a connector holder unit according to an embodiment of the invention.

Hereinafter, an embodiment of the present invention will be described with reference to the accompanying drawings. FIG. 1 is a perspective view of a carriage for an ink jet printer according to an embodiment of the invention. FIG. 2A is a side sectional view of a connector and the vicinity thereof according to an embodiment of the invention. FIG. 2B is an enlarged side sectional view of the connector and a lower side thereof. FIG. 3 is a perspective view of the inside of a carriage according to an embodiment of the invention at a time right before installment of a connector holder unit. FIG. 4 is a perspective view of the inside of the carriage at a time when the connector holder unit is installed. FIG. 5 is an exploded perspective view of constituent members adjacent to the connector holder according to an embodiment of the invention. FIG. 6 is a longitudinal sectional view of a connector according to an embodiment of the invention. FIG. 7 is a perspective view of the inside of a carriage according to an embodiment of the invention, showing the vicinity of a circuit substrate. FIG. 8 is a perspective view of the back side of a connector holder unit according to an embodiment of the invention. FIG. 9 is a perspective view of the front side of a connector holder unit according to an embodiment of the invention. FIGS. 10A to 10E are diagrams showing an operation of attaching a circuit substrate to a connector holder according to an embodiment of the invention. FIGS. 11A to 11D are diagrams showing an operation of attaching a circuit substrate to a connector holder according to another embodiment of the invention.

In FIG. 1, reference numeral 1 denotes a carriage 1, and a recording head unit 2 (see FIGS. 2A and 2B) is provided on the lower side of the carriage 1. The recording head unit 2 includes a head portion 4 having a nozzle array (not shown) for ejecting ink and a head base body 40 having a position determining portion 18 by which an ink outlet portion 20 of an ink cartridge 5 is set together with fixing of the head portion 4 for determination of the position of the ink. A lower position determining rib 8 partitioning the position determining portion 18 of the head base body 40 is configured to serve as a supported portion 24 to be described later. The recording head unit 2 is fastened to be fixed to the carriage 1 through a support portion 46 locating on the outer side of the lower position determining rib 8 of the head base body 40.

The carriage 1 can reciprocate along a carriage guide shaft or a carriage guide rail 3 in a direction perpendicular to a transport direction of a recording medium and performs recording on the recording medium. In the carriage 1, there is formed a plurality of cartridge receiving portions 7 for containing the ink cartridges 5. In description below, a side facing a left-front side in FIG. 1 is referred to as a front side of the carriage 1 and an opposite side thereto is referred to as a back side of the carriage 1. Like the carriage 1, sides of members attached to the carriage 1 will be referred to as front and back sides in accordance with their attached sides of the carriage 1. Specifically, sides of a connector holder in a status that the connector holder is attached to the inside of the carriage will be referred to as the same sides as the sides of the carriage.

On the back side of the carriage 1, a circuit substrate 9 (see FIGS. 2A and 2B) is provided, and a conductive connection portion 12 is formed on the circuit substrate 9. On a back side of an inner face of the carriage 1, connectors 11 are provided in correspondence with the cartridge receiving portions 7. The connectors 11 are held by connector holders 13 (see FIG. 9). As shown in FIG. 3, the connector holder 13 is held by fitting both ends 14 of the connector holder 13 to a groove portion 16 of the carriage 1 using a sliding method. In this holding status, the connector holder 13 is configured to be located above the support portion 46 inside the carriage 1. To be more specific, the recording head unit 2 and the connector holder 13 are configured to be overlapped with each other in an assembly direction, and whereby it is possible to decrease a size of the carriage 1 in its inner depth direction.

According to an embodiment of the invention, all the connector 11 and the circuit substrate 9 are attached to the connector holder 13 in advance before the connector holder 13 is attached to the carriage 1. However, in description below, a connector holder unit 74 is defined as a connector holder 13 to which all the connector 11 and circuit substrate 9 have been attached in advance.

An inside bottom portion of the carriage 1 is constituted by the head base body 40 of the recording head unit 2. In this portion, ink supply openings 6 are formed to protrude in accordance with the cartridge receiving portions 7, peripherals of the ink supply openings 6 are partitioned by the protruding lower position determining rib 8, and the inside of partitioned portion is configured to be the position determination portion 18 for determination of the position of the ink cartridge 5. In this embodiment, four position determining portions 18 are formed corresponding to the cartridge receiving portions 7. On a connector holder 13 side of the lower position determining rib 8, that is, a wall face opposite to the position determining portions 18 is formed to be a supported portion 24. The operation of the supported portion 24 will be described later.

In each ink cartridge 5, as shown in FIG. 5, a cartridge side substrate 15 is formed on a face facing the connector 11 and a locking lever 17 (see FIG. 1) used for fixing the ink cartridge 5 to the carriage 1 is provided above the cartridge side substrate 15. In addition, on the cartridge side substrate 15, conductive connection portions 10 (see FIG. 5, etc.) are formed. The ink cartridge 5 is configured to be fixed to the inside of the cartridge receiving portion 7 using snap fitting by slight and temporary elastic deformation of the locking lever 17 at a time when the ink cartridge 5 is pushed into the cartridge receiving portion 7.

The connector 11, as shown in FIG. 6, includes a first face 19 facing the cartridge side substrate 15 and a second face 21 facing the circuit substrate 9 that is provided on the back side of the carriage 1. The connector 11 has a function for electrical conduction between the cartridge side substrate 15 and the circuit substrate 9 by being interposed therebetween. The connector 11, for example, has nine metal contacts 25 that are disposed parallel to one another for a housing 23 made of known materials. The nine contacts 25 are disposed in two lines to be in the same position every other line when viewed from the side, and contacts 25 adjacent to each other are disposed to be in different positions in the longitudinal direction of the housing 23 and are disposed in a zigzag pattern on the whole.

The contacts 25 have a same shape. Each contact 25 includes a first contact arm 29 that extends to the first face 19 side from a base end portion 27 and a second contact arm 31 that extends to the second face 21 side and is shorter than the first contact arm 29, as main frames. In front ends of the contact arms 29 and 31, contact terminals 33 and 35 in the shape of an approximate half circle are formed. The second contact arm 31 is formed shorter than the first contact arm 29. A base end portion 27 of each contact 25 is press-fitted to a thin plate-shaped portion 37 formed in the housing 23, and whereby the contact 25 is supported by the housing 23.

The contact terminals 33 and 35 of the first and second contact arms 29 and 31 respectively protrude from the first and second faces 19 and 21, and the first and second contact arms 29 and 31 are configured to bend inward in the shape of a plate spring when load is applied to the contact terminals 33 and 35. By the action of the spring, the contact terminals 33 and 35 can be brought into tight contact with the conductive connection portion 10 of the cartridge side substrate 15 and the conductive connection portion 12 of the circuit substrate 9, and accordingly, electrical connection therebetween can be made assuredly.

As shown in FIG. 8, the circuit substrate 9 is held on the back side of the connector holder 13 by holding ribs 39. In a status that the connector holder 13 is set inside the carriage 1, as shown in FIG. 7 (the connector holder 13 is omitted in the figure for easy understanding), four back side support portions 41 having a shape of a rib formed inside the carriage 1 are brought into contact with the back side of the circuit substrate 9 so as to prevent backward bending-like deformation of the circuit substrate 9. As described above, since a force for bending the circuit substrate 9 outward is applied when the contact terminals 33 and 35 are brought into tight contact with the conductive connection portion 10 of the cartridge side substrate 15 and the conductive connection portion 12 of the circuit substrate 9, the prevention of the deformation of the circuit substrate 9 is made for maintaining electrical connection assuredly by regulating the bending of the circuit substrate 9.

As shown in FIG. 9, in a bottom portion of the front side, that is, the ink cartridge 5 side of the connector holder 13, a deformation preventing support portion 43 is formed. The deformation preventing support portion 43 is provided as a convex portion around the center of the connector holder 13. The deformation preventing support portion 43 has a trapezoid shape, and a shorter side of the trapezoid is formed as a support face 45. As shown in FIG. 4, the dimension of the deformation preventing support portion 43 is set such that the support face 45 is brought into contact with the supported portion 24 formed on the connector holder 13 side of the lower position determining rib 8 when the connector holder 13 is set inside the carriage 1.

As described above, since the deformation preventing support portion 43 is configured to contact the supported portion 24 provided inside the carriage 1 when the connector holder 13 is set inside the carriage 1, the following advantages can be obtained.

Since a force for bending the circuit substrate 9 outward is suppressed by the back side support portion 41 when the contact terminals 33 and 35 tightly contact the conductive connection portion 10 of the cartridge side substrate 15 and the conductive connection portion 12 of the circuit substrate 9, the connector holder 13 tends to bend to the ink cartridge 5 side as a counteraction thereof. However, since the deformation preventing support portion 43 is brought into contact with the supported portion 24, the connector holder 13 can continuously maintain its original form without being bent to the ink cartridge 5 side. Thus, deformation of the circuit substrate 9 on the basis of the deformation of the connector holder 13 can be suppressed, and accordingly, it is possible to maintain a status of excellent connection between the contact terminals 33 and 35 and the conductive connection portions 10 and 12.

Especially when the ink cartridge 5 is in a status of being detached from the cartridge receiving portion 7, elastic contact between the conductive connection portion 10 of the ink cartridge 5 and the connector 11 disappears, and thus, a force for reducing the deformation of the connector holder 13 to the ink cartridge 5 side disappears from that portion. In this embodiment of the invention, even in such case, the deformation of the connector holder 13 is suppressed by using a structure for bring the support portion 43 into contact with the supported portion 24.

In addition, since the lower position determining rib 8 partitioning the position determining portion 18, by which the ink outlet portion 20 of the ink cartridge 5 is set for determining the position of the ink cartridge 5, is configured to serve as the supported portion 24, that is, both wall faces of inner and outer wall faces of the lower position determining rib 8 partitioning the position determining portion 18 of the head base body 40 perform a position determining function of the ink cartridge 5 and a deformation preventing function of the connector holder 13, the contact distance and contact pressure between the conductive connection portion 10 of the ink cartridge 5 and the connector 11 can be adjusted with high precision.

Hereinafter, a configuration according to an embodiment of the invention will be described. As described above, a basic feature of the invention is that the connector 11 and the circuit substrate 9 are attached to the connector holder 13 in advance for forming the connector holder unit 74 other than that the connector 11 and the circuit substrate 9 are attached to the connector holder 13 after attachment of the connector holder 13 to the carriage 1. As described above, since a form of the connector holder unit 74 is used, it is not needed to install the circuit substrate 9 to the connector holder 13 by using a sliding method, and accordingly, a problem such as generation of foreign bodies due to cut of resists does not occur. In addition, an operation for installment of the connector 11 and the circuit substrate 9 can be simplified, compared to a case where the connector 11 and the circuit substrate 9 are attached after attachment of the connector holder 13 to the carriage 1.

Figures 10A, 10B, 10C, 10D, 10E:
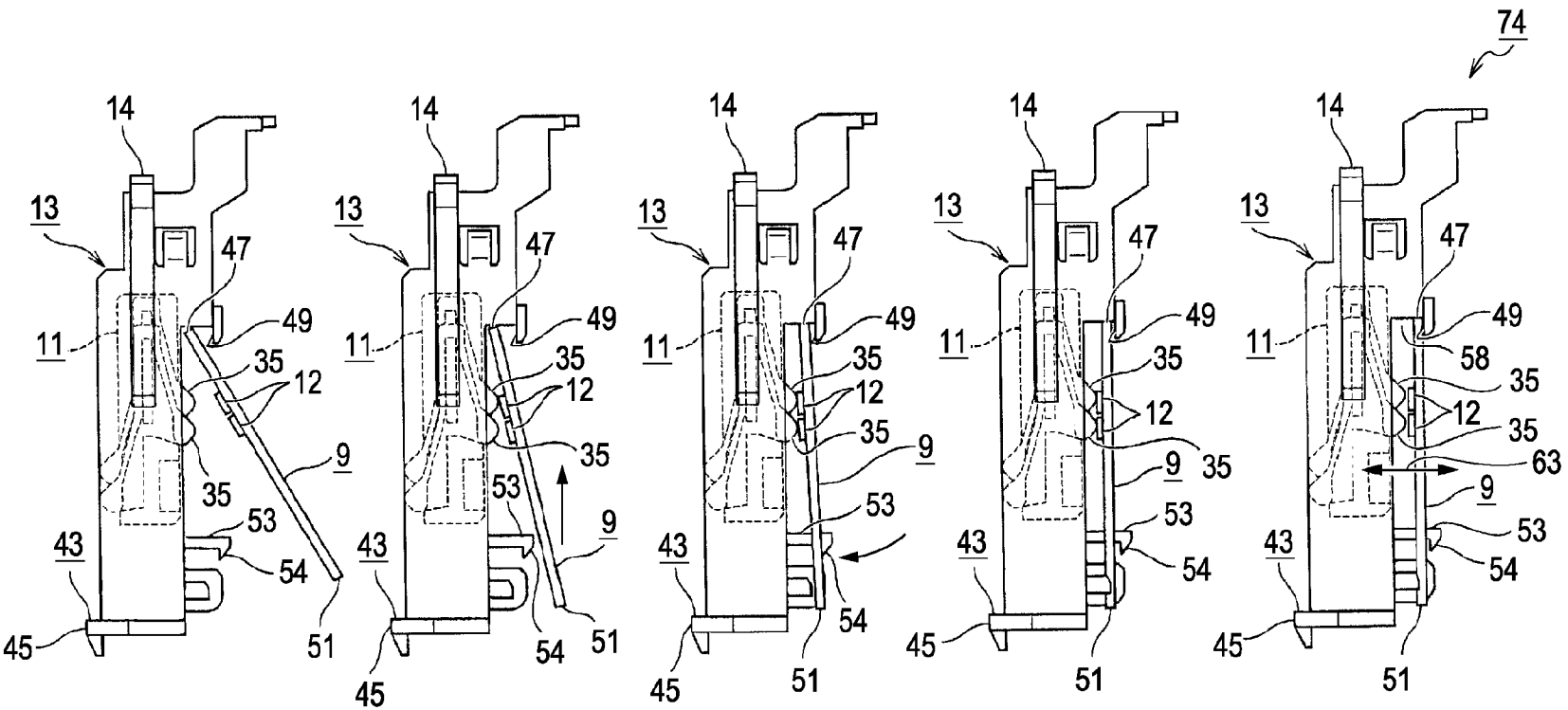
FIGS. 10A to 10E are diagrams showing an operation of attaching a circuit substrate to a connector holder according to an embodiment of the invention.

In a process for assembly of the connector holder unit 74, for example, methods shown in FIGS. 10A to 10E and 11A to 11D can be used for the attachment of the circuit substrate 9 to the connector holder 13. In the method shown in FIGS. 10A to 10E, as shown in FIG. 10A, a flexible hook 53 is formed in the connector holder 13 and a locking portion (not shown) into which the flexible hook 53 is locked is formed in a position corresponding to a position of the flexible hook 53 on the circuit substrate side 9. As shown in FIG. 10B, an upper side 47 of the circuit substrate 9 is fixed to the inside of a reverse concave-shaped position determining portion 49. Thereafter, as shown in FIG. 10C, the circuit substrate 9 is pivoted about the fixed upper side 47 (center of pivoting) so as to approach a lower side 51 to the connector holder 13 side. When the conductive connection portion 12 is brought into contact with the contact terminal 35, as shown in FIG. 10D, the upper 47 side of the circuit substrate 9 moves to a back side from the contact terminal 35. As shown in FIG. 10E, finally, the lower side 51 side of the circuit substrate 9 is fixed by locking a locked portion with a front end locking portion 54 of the flexible hook 53 and the upper side 47 side of the circuit substrate 9 is locked with the rear side of the reverse concave-shaped position determining portion 49 for being fixed.

Figures 11A, 11B, 11C, 11D:
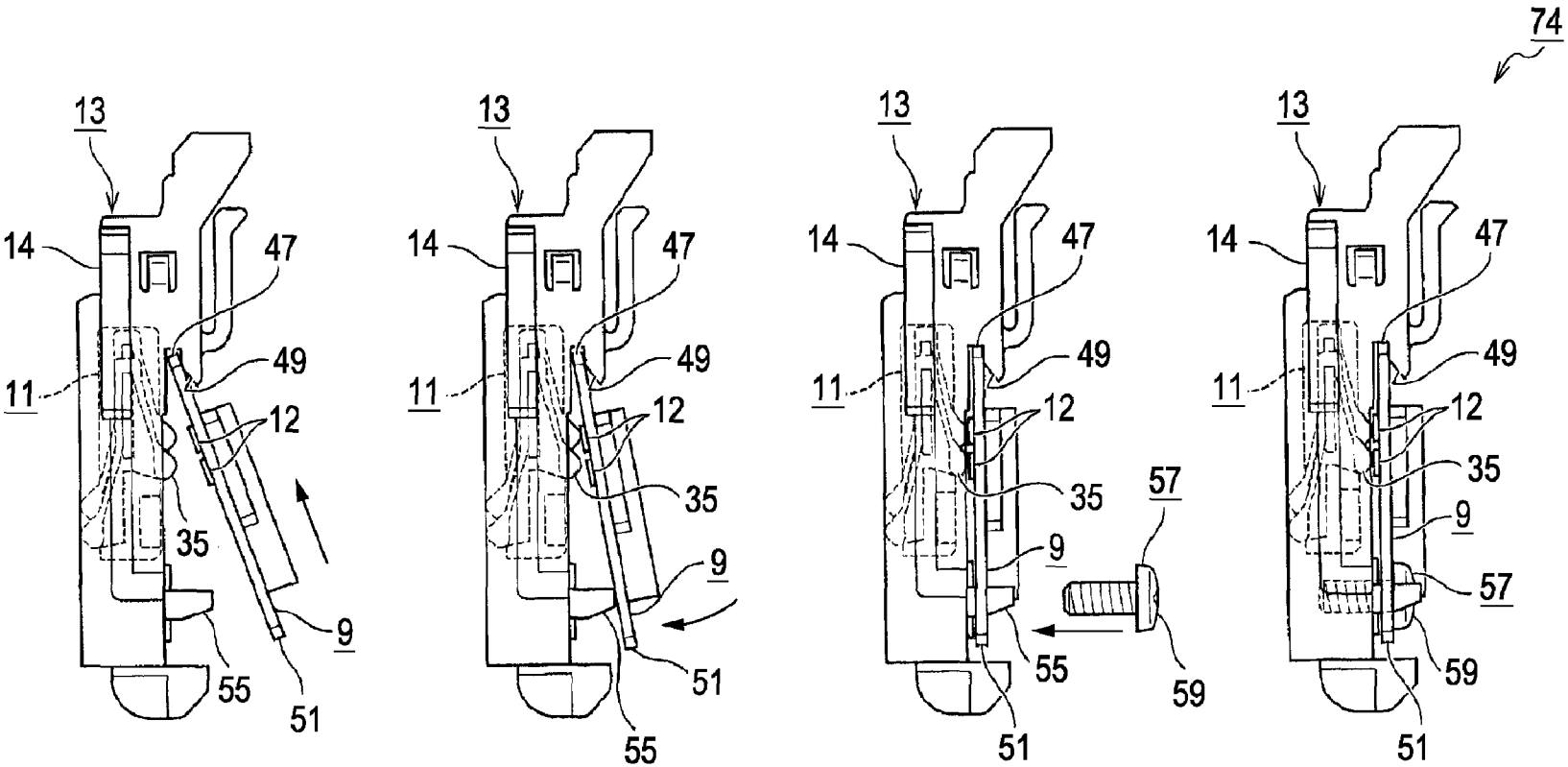
FIGS. 11A to 11D are diagrams showing an operation of attaching a circuit substrate to a connector holder according to another embodiment of the invention.

In the method shown in FIGS. 11A to 11D, as shown in FIG. 11A, a position determining guide protrusion 55 and a screw combining portion (not shown) are formed in the connector holder 13, and an opening (not shown) through which the position determining guide protrusion 55 passes is formed on the circuit substrate side 9. As shown in FIG. 11A, the upper side 47 of the circuit substrate 9 is fixed to the reverse concave-shaped position determining portion of the connector holder 13. Thereafter, as shown in FIG. 11B, the circuit substrate 9 is pivoted about the fixed upper side 47 so as to approach the lower side 51 to the connector holder 13 side. Then, the circuit substrate 9 is pivoted to a predetermined position such that the position determining guide protrusion 55 is inserted into the opening, and as shown in FIG. 11C, a fixing screw 57 is screwed into a screw coupling portion, and whereby the lower side 51 side of the circuit substrate 9 is fixed to have a clearance in front and rear directions by a head portion 59 of the fixing screw 57 (see FIG. 11D).

As shown in FIG. 10E of the embodiment shown in FIGS. 10A to 10E described above, when the circuit substrate 9 is attached to the connector holder 13, the upper side 47 of the circuit substrate 9 is configured to be able to slightly move in the front or rear direction of the connector holder, as denoted by an arrow 63, in the range of the clearance 58 formed in the reverse concave-shaped position determining portion 49. In addition, the lower side 51 side of the circuit substrate 9 is configured to be able to move between positions in a status (FIG. 10E) that a front end locking portion 54 of the flexible hook 53 is locked into the locking portion and a status (FIG. 10D) that the lower side 51 side is pushed in a front direction for resisting an elastic force of the contact terminal 35. As a result, the circuit substrate 9 is attached to the connector holder 13 in a status that the circuit substrate 9 can slightly move in the front or rear direction of the connector holder 13. The embodiment shown in FIGS. 11A to 11D operates the same as described above by providing the clearance.

As described above, since the circuit substrate 9 is connected to the connector holder 13 in a status that the circuit substrate 9 is movable in a front or rear direction of the connector holder 13, the following advantages can be obtained. While the circuit substrate 9 and the connector 11 are mounted on the connector holder 13 in advance for forming the connector holder unit 74 before being attached to the carriage 1 according to a embodiment of the invention, there is a case where it takes a long time from storage as the connector holder unit 74 to installment of the connector holder unit 74 to the carriage 1. In such case, a force pressing the circuit substrate 9 to its back side in accordance with the spring force of the contact 25 is applied to the connector holder 13, and whereby the connector holder 13 may be deformed to be bent. Thus, there is a case where the deformed connector holder unit 74 cannot be attached to the carriage 1. However, since the circuit substrate 9 is attached in a status that the circuit substrate 9 is slightly movable in the front or of rear direction of the connector holder 13, a spring force of the contact 25 reduces a biasing force applied to the connector holder 13, and whereby bending deformation of the connector holder 13 can be prevented.

In addition, in the form of the connector holder unit 74, although the circuit substrate 9 is slightly movable in the front or rear direction of the connector holder 13, the contact terminals 33 and 35 can be brought into tight contact with the conductive connection portion 10 of the cartridge side substrate 15 and the conductive connection portion 12 of the circuit substrate 9 on the basis of the spring action by attaching the connector holder unit 74 to the carriage 1, and the position of the circuit substrate 9 with respect to the carriage 1 is fixed by the back side support portion (rib) 41 inside the carriage.

Figure 12:
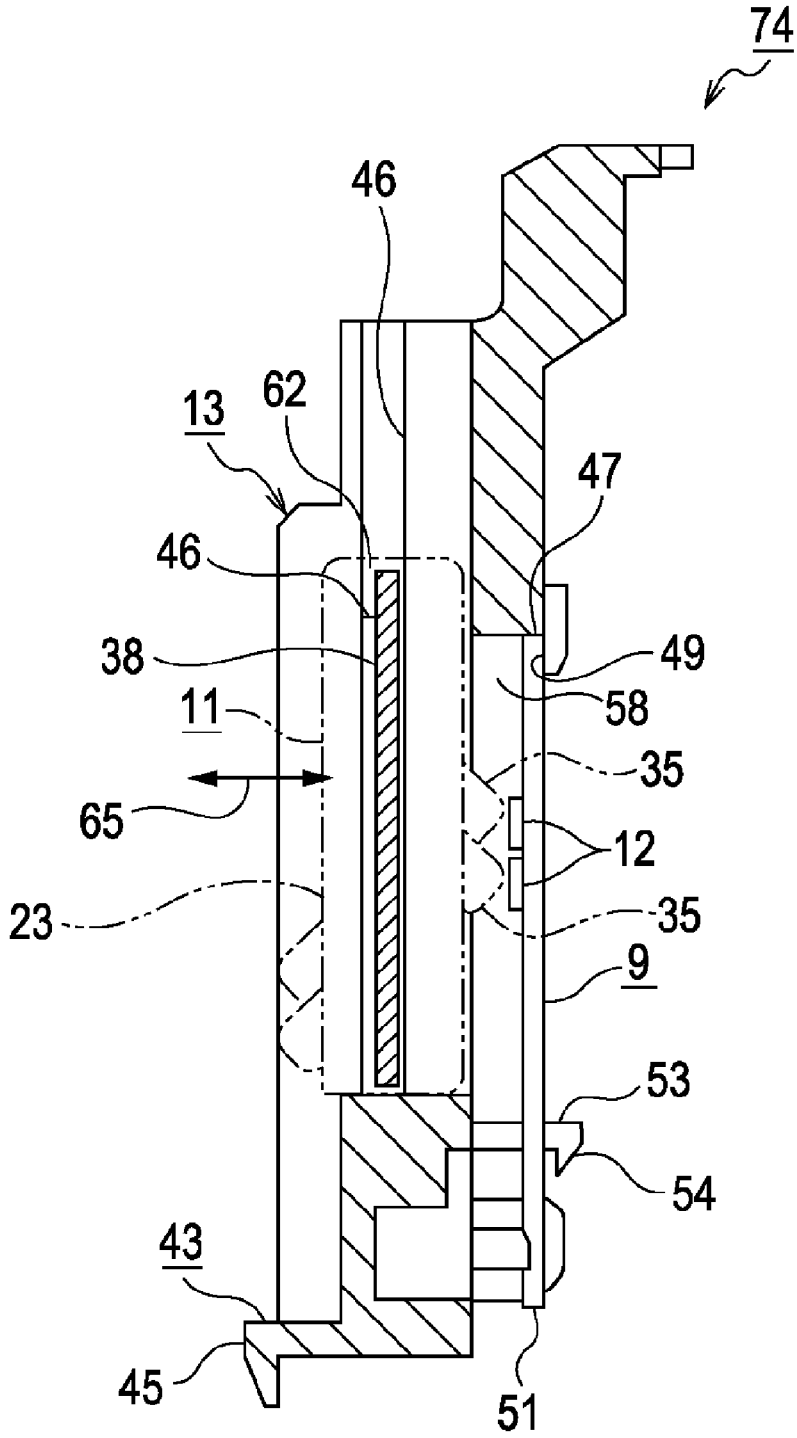
FIG. 12 is a vertical sectional view showing a clearance between a support portion of a connector holder and a supported portion of a housing according to an embodiment of the invention.
Figure 13:
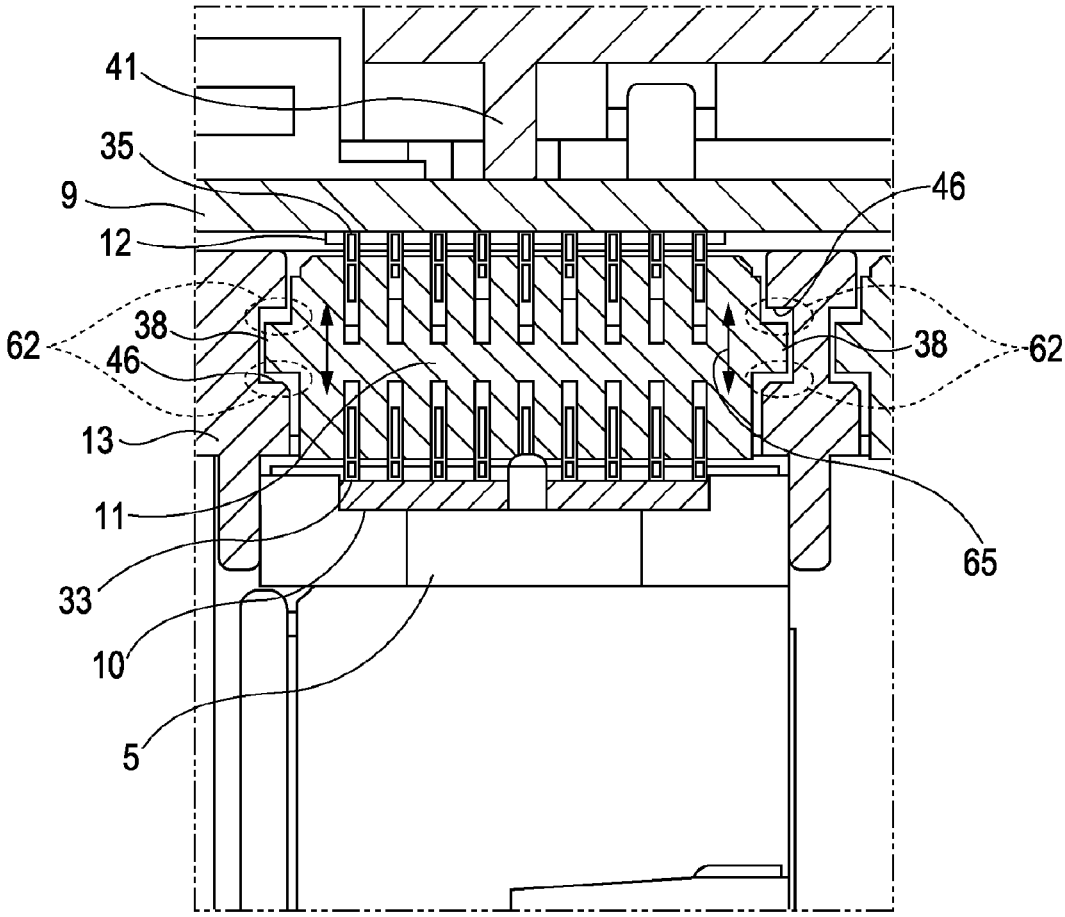
FIG. 13 is a horizontal sectional view of the circuit substrate and the connector holder shown in FIGS. 11A to 11D.

As shown in FIGS. 12 and 13, a clearance 62 is formed between the support portion 46 (see FIG. 5) of the connector holder 13 and the supported portion 38 (see FIG. 5) of the housing 23 of the connector 11 such that the housing 23 is slightly movable in the front or rear direction of the connector holder 13. According to an embodiment of the invention, the housing 23 of the connector 11 is configured to be slightly movable in the front or rear direction of the connector holder 13 and the circuit substrate 9 may not be configured to be movable with respect to the connector holder 13.

In this embodiment of the invention, since the clearance 62 through which the housing 23 can move with respect to the connector holder unit 74 is formed between the support portion 46 of the connector holder 13 and the supported portion 38 of the housing 23, the housing 23 is slightly movable with respect to the connector holder unit 74. Accordingly, although the connector holder 13 inside the carriage 1 is deformed to be bent for any reason, the deformation force is absorbed by the clearance 62, and thus, the effect of the deformation on the status of contact between the contact terminals 33 and 35 of the connector side 11 and the conductive connection portion 10 of the ink cartridge 5 and/or the conductive connection portion 12 of the circuit substrate 9 can be prevented.

In other words, in a status that the connector unit 74 in which the connector 11 and the circuit substrate 9 are installed to the connector holder 13 is attached to the carriage 1, the contact terminals 33 and 35 of the connector 11 are brought into elastic contact with the conductive connection portion 10 of the ink cartridge 5 and the conductive connection portion 12 of the circuit substrate 9, and whereby electrical conduction between the circuit substrate 9 and the ink cartridge 5 is made.

In this status of the elastic contact, since the positions of the contact terminals 33 and 35 of the connector 11, the conductive connection portion 10 of the ink cartridge 5, and the conductive connection portion 12 of the circuit substrate 9 are maintained in a status that contact pressures of the contact portions are balanced by the elastic force, it is preferable that the position of the connector 11 is not restricted by the connector holder 13 in this status for optimization of the balance. According to an embodiment of the invention, an appropriate structure is implemented by using the clearance 62, and since the position of the connector 11 is not restricted to have a degree of freedom by using the clearance 62, the balance of contact pressures of the contact portions is improved. In addition, although the connector holder 13 is deformed for any reason, the effect thereof can be prevented.

Since the circuit substrate 9 and the connector 11 are mounted on the connector holder 13 to form the connector holder unit 4 before the attachment of the connector holder 13 to the carriage 1, the following advantages can be obtained. There is a case where it takes a long time from storage as the connector holder unit 4 to installment of the connector holder unit 74 to the carriage 1. In such case, a force pressing the circuit substrate 9 or the housing 23 to its back side in accordance with the spring force of the contact 25 is applied to the connector holder 13, and whereby the connector holder 13 may be deformed to be bent. As a result, there is a case where the deformed connector holder unit 4 cannot be attached to the carriage 1. According to an embodiment of the invention, since the effect of the biasing force applied to the connector holder 13 in accordance with the spring force of the contact 25 is reduced by using the clearance 62, and whereby bending deformation of the connector holder 13 in its front and rear direction can be prevented.

In the embodiment described above, the circuit substrate 9 and the connector 11 are configured to be movable in the front or rear direction of the connector holder 13, but the circuit substrate 9 and the connector 11 may be configured to be movable in an upper or lower direction in FIGS. 11A to 11D or in a front or back sides of page space of FIGS. 11A to 11D. As described above, by diversification of the movable directions of the circuit substrate 9 and the connector 11, the bending deformation of the connector holder 13 in various directions other than the front or back direction can be prevented.

While an embodiment of the invention has been described, however, various modified examples thereof can be used. In the above-described embodiment, although an ink jet printer as a recording apparatus is described as an example, the present invention may be applied to a liquid ejecting apparatus that causes liquid to adhere onto a medium, corresponding to the recording medium in the above described recording apparatus, by ejecting liquid selected depending on the use of the apparatus in place of ink onto the medium from a liquid ejecting head corresponding to the above-described ink jet recording head.

What is claimed is:

1. A connector holder unit that is formed separately from a carriage capable of housing an ink cartridge and can be attached to the inside of the carriage, the connector holder unit comprising:

a connector holder that is formed separately from the carriage capable of housing the ink cartridge such that the connector holder does not house the ink cartridge, wherein the connector holder is attached to the inside of the carriage by being slid into a groove formed on the inside of the carriage in a side that is adjacent to the bottom of the carriage where ink from the ink cartridge is ejected from the ink cartridge;

a connector having a plurality of contact arms that is installed to the connector holder; and a circuit substrate having a plurality of conductive connection portions that is installed to the connector holder, wherein contact terminals of the plurality of contact arms of the connector are configured to elastically contact the conductive connection portions of the circuit substrate and conductive connection portions of the ink cartridge so as to electrically conduct between the circuit substrate and the ink cartridge when the connector holder unit is attached to the carriage, wherein the connector holder is interposed between the circuit substrate and the ink cartridge when the ink cartridge is placed in the carriage such that the connector holder separates the circuit substrate from the ink cartridge.

2. The connector holder unit according to claim 1, wherein the connector holder includes a support portion supporting a housing;

wherein the housing includes a supported portion supported by the support portion; and wherein a clearance that enables the housing to move with respect to the connector holder unit is formed between the support portion of the connector holder and the supported portion of the housing.

3. The connector holder unit according to claim 1, wherein the plurality of contact arms includes a first contact arm that protrudes from a first face side facing a cartridge side substrate and a second contact arm that is provided on a back side of the carriage and protrudes from a second face side facing the circuit substrate.

4. The connector holder unit according to claim 3, wherein contact terminals in the shape of a half circle are provided in front ends of the plurality of contact arms, and wherein the length of the second contact arm is formed to be shorter than that of the first contact arm.

5. The connector holder unit according to claim 2, wherein the circuit substrate is installed to the connector holder to have the clearance that enables the circuit substrate to move in the front or rear direction of the connector holder.

6. The connector holder unit according to claim 2, wherein the circuit substrate has a configuration in which the circuit substrate is pivoted about one side between upper and lower sides of the circuit substrate in a status that the side of the circuit substrate is supported by a position determining portion of the connector and the other side is approached to the connector holder for being engaged with the connector holder.

7. A carriage that can house an ink cartridge, the carriage comprising the connector holder unit according to claim 1.

8. A recording apparatus comprising:

a transport unit transporting a recording medium;

a recording unit performing recording on the recording medium that is transported by the transport unit; and a carriage that reciprocates in a main scanning direction which is perpendicular to a transport direction of the recording medium, wherein the carriage is the carriage according to claim 7.

* * * * *